United States Patent [19]

Penkunas et al.

[11] Patent Number: 4,902,471

[45] Date of Patent: Feb. 20, 1990

[54] METHOD FOR PRODUCING METAL CARBIDE GRADE POWDERS

[75] Inventors: Joseph J. Penkunas; Theodore E. Smith, Jr., both of Sayre, Pa.

[73] Assignee: GTE Products Corporation, Stamford, Conn.

[21] Appl. No.: 405,707

[22] Filed: Sep. 11, 1989

[51] Int. Cl.[4] ..... B22F 1/00

[52] U.S. Cl. ..... 419/33; 75/5 A; 75/5 AA; 75/5 AC; 419/36; 419/37; 419/40; 419/65; 419/66; 419/35; 419/64

[58] Field of Search ..... 419/36, 37, 40, 35, 419/65, 66, 35, 64; 75/0.5 A, 0.5 AA, 0.5 AC

[56] References Cited

U.S. PATENT DOCUMENTS

| | | | |
|---|---|---|---|
| 4,011,291 | 3/1977 | Curry | 419/37 |
| 4,397,889 | 8/1983 | Benjamin et al. | 419/33 |
| 4,478,888 | 10/1984 | Benjamin et al. | 419/33 |
| 4,491,559 | 1/1985 | Grab et al. | 419/36 |
| 4,830,994 | 5/1989 | Schuetz | 419/65 |

*Primary Examiner*—Stephen J. Lechert, Jr.
*Attorney, Agent, or Firm*—David J. Koris

[57] ABSTRACT

A method is disclosed for producing metal carbide grade powders, which comprises forming a wax mixture consisting essentially of in percent by weight about 10 to 60 of an organic compound additive which is a solid at room temperature and contains a C=O group, about 5 to about 50 oils, and the balance paraffin, heating the wax mixture to a temperature above the melting point of the wax mixture and maintaining the temperature, forming a powder-wax mixture of metal carbide powder, a binder metal selected from the group consisting of cobalt, nickel, and combinations thereof, and the wax mixture, while heating the carbide powder, binder metal and wax mixture to a temperature above the melting point of the wax mixture and maintaining the temperature, to result in a uniform distribution of the wax mixture on the carbide and binder metal particles, forming a slurry of the powder-wax mixture and water, attritor milling the slurry at a temperature below the melting point of the wax, and removing the water from the resulting attritor milled powder-wax mixture and agglomerating the mixture to produce the metal carbide grade powder wherein a densified article made therefrom exhibits essentially no pores that are greater than about 10 micrometers in diameter after sintering at about 1350° C. to 1540° C.

5 Claims, No Drawings

METHOD FOR PRODUCING METAL CARBIDE GRADE POWDERS

This invention relates to a method for producing metal carbide grade powders in which there is an even distribution of the wax binder on the powder particles. This is brought about as a result of using a solid organic compound having a C═O group and a specific amount of oils as part of the wax binder mixture. The grade powder product thus produced is essentially free of micropores, that is, pores which measure from about 10 to about 25 micrometers in diameter and essentially free of macropores, that is, pores greater than about 25 micrometers in diameter after sintering at a temperature of from about 1350° C. to about 1540° C. As a result of the composition of the wax mixture in particular the amount of oils, the grade powder is able to be pressed into intricate shapes at lower pressures than were used prior to the invention.

In the production of metal carbide grade powders there is a problem of uneven distribution of the wax binder on the powder particle surfaces. The uneven distribution results from the fact that in attritor milling of the powders with wax, the wax materials frequently separate from the powder. As a result, densified articles made from these powders exhibit porosity and void defects, which adversely affect the strength and wear properties of the article. Also, producing complex articles with detailing is difficult because of the porosity. High pressures of about 12 to 15 tons per square inch must be used.

SUMMARY OF THE INVENTION

In accordance with one aspect of the invention, there is provided a method for producing metal carbide grade powders, which comprises forming a wax mixture consisting essentially of in percent by weight about 10 to 60 of an organic compound additive which is a solid at room temperature and contains a C═O group, about 5 to about 50 oils, and the balance paraffin, heating the wax mixture to a temperature above the melting point of the wax mixture and maintaining the temperature, forming a powder-wax mixture of metal carbide powders, a binder metal selected from the group consisting of cobalt, nickel, and combinations thereof, and the wax mixture, while heating the carbide powder, binder metal and wax mixture to a temperature above the melting point of the wax mixture and maintaining the temperature, to result in a uniform distribution of the wax mixture on the carbide and binder metal particles, forming a slurry of the powder-wax mixture and water, attritor milling the slurry at a temperature below the melting point of the wax, and removing the water from the resulting attritor milled powder-wax mixture and agglomerating the mixture to produce the metal carbide grade powder wherein a densified article made therefrom exhibits essentially no pores that are greater than about 10 micrometers in diameter after sintering at about 1350° C. to 1540° C.

DETAILED DESCRIPTION OF THE INVENTION

For a better understanding of the present invention, together with other and further objects, advantages and capabilities thereof, reference is made to the following disclosure and appended claims in connection with the above description of some of the aspects of the invention.

The present invention provides a method by which metal carbide grade powders can be produced. By grade powders is meant the carbide powder with a binder metal which is typically cobalt or nickel or combinations thereof. The metal carbides which are especially suited to the practice of the invention are tungsten carbide, titanium carbide, tantalum carbide, niobium carbide, vanadium carbide, chromium carbide, and combinations thereof.

Even distribution of the wax on the particle surfaces during attritor milling is often difficult or nearly impossible to achieve due to the poor mixing of the wax in the solid state with the water. It is believed that the active radical of the paraffin wax additive must attach itself to the powder surface in the molten state. The radical cannot rotate or reattach in a solid state or in a state when it is no longer active, that is, in which it has reacted or has been rendered neutral by forming hydrogen bonds with something other than the powder surface, such as water.

Densified articles made from the grade powders produced by the method of the present invention are essentially free of B type porosity and voids when sintered at from about 1350° C. to about 1540° C. This is not normally achieved when the grade powders are produced by the prior method of using a wax which does not contain a C═O group. ASTM defines A porosity as holes up to about 10 micrometers in diameter and B porosity as from about 10 to about 25 micrometers in diameter, whereas macropores commonly called voids are greater than about 25 micrometers in diameter. The above described articles are essentially free of pores greater than about 10 micrometers in diameter. This is done by using a solid organic compound having a C═O group in the wax mixture. As a result of the even distribution of the wax on the carbide powder surfaces, the cobalt which is bound to the carbide by the wax is evenly distributed throughout the carbide. If the wax is not evenly distributed on the carbide-binder metal particles, much free wax is generated and it is this free wax that causes the microporosity and macroporosity defects. Additionally, by including a specific amount of oils in the wax mixture thereby controlling the hardness of the wax binder, the wetting of the powder and lubrication is enhanced and the ability of the wax to support a stress is decreased and as a result, the powder can be subsequently pressed into articles of intricate detail at lower pressures than previously used. For example prior to the present method of controlling the oil content, pressures of about 12 to 15 tons per square inch were needed whereas the powders produced by the method of the present invention can be pressed at pressures of about 7 to 10 tons per square inch. This reduction in pressing pressure has the advantage of increasing the life of articles such as tools and reduction of lamination type of pressing defects both of which are associated with high pressing pressures. The method of the present invention will now be described.

A wax mixture is formed consisting essentially of paraffin, an organic additive compound which is a solid at room temperature, that is about 20° C. to about 65° C., and one or more oils. The paraffin or paraffinic wax is refined, having a melting point of from about 50° C. to about 55° C. The organic additive compound contains a C═O group. One of the keys to the successful use of the wax mixture of the present invention is in the electronic configuration of the C═O group. The electrons available are able to form hydrogen type bonds with the carbide-binder material metal powder particle surfaces. The coating of the carbide-binder metal powder particle surfaces is done with the wax mixture in the molten state so that the molecules can move and rotate so that the C═O group can come into contact with the carbide-binder metal powder particle surfaces. This is in contrast to a normal paraffin which is electron neutral, wets the powder poorly and has little or no affinity for the powder surface. The organic compound makes up from about 10% to about 60% by weight of the wax mixture. The organic compound can be an ester of a fatty acid. Some preferred esters are beeswax and carnuba wax. Some preferred fatty acids are lauric acid, myristic acid, palmitic acid, stearic acid, and combinations thereof. The organic compound is made part of the wax mixture to increase the functionality of the wax mixture. The oils make up from about 5% to about 50% and preferably about 5% to about 30% by weight of the wax mixture. The balance of the mixture is paraffin. The oils can be derived from animal, vegetable or mineral sources. It is important that the oils be non-contaminating so that when they are subsequently removed by de-waxing, there are no residues on the grade powder product. The preferred oils are paraffinic oils, esterified oils or acidic oils, or combinations thereof. Some preferred oils are mineral oil, palm kernal oil and oleic acid. The are made part of the mixture to decrease the hardness of the wax mixture as explained previously.

The wax mixture is heated above the melting point of the mixture and the temperature is maintained.

A powder-wax mixture is formed consisting essentially of a metal carbide powder, a binder metal which can be cobalt, nickel or combinations of these, and the above described wax mixture. Typically about 98% by weight of the metal carbide and binder metal powder is mixed with about 2% by weight of the wax mixture. The wax serves as a lubricant or binder to bind the carbide particles to the metal binder particles. The wax is normally in flaked form. The mixing is done typically in a stream jacketed mixer. Mixing is carried out until the wax is completely melted and evenly distributed throughout the carbide and binder metal powders. After sufficient mixing time which depends on the type of equipment and the amount of material, the powder-wax mixture is cooled by closing off the steam lines and opening up the cold water lines. The mixer is allowed to operate during the cooling causing the powder-wax to remain as a fluffy powder and not clumps or chunks.

A slurry is then formed of the resulting powder-wax mixture and water. The slurry is typically about 80% by powder-wax mixture and the balance water.

The resulting slurry is then attritor milled. The water serves as the milling fluid. The milling time is sufficient to allow the complete mixing of the carbide, binder metal, and wax so that when a densified cemented carbide article is made from the resulting powder, the article exhibits essentially no B type porosity and essentially no voids. The milling time is typically from about 2 hours to about 12 hours depending on mill loading parameters. The attritor milling insures uniform mixing of the carbide and metal powders and the wax. With the waxes already affixed to the carbide and binder metal, there is little or no wax separation from the carbide during milling as the aqueous slurry is maintained below the melting point of the wax phase.

After the attritor milling step, the water is removed from the attritor milled powder-wax mixture, and the mixture is agglomerated. This is done typically by spray drying the slurry. This removes the water and allows the carbide-binder metal-wax to form a spherical shape. The resulting dry spherical powder/wax grade mix agglomerates are then ready to be processed by conventional methods to produce densified articles therefrom. These methods involve generally formation of a green article, and thereafter removing the wax and sintering.

Since the wax does not separate from the powder during milling and drying and agglomerating, the incidence of porosity defects of the resulting articles attributed to uneven wax distribution is virtually eliminated.

To more fully illustrate this invention, the following non-limiting example is presented.

EXAMPLE

About 10 kg of WC is mixed with about 0.64 kg of cobalt and about 0.217 kg of a wax mixture. The wax mixture consists essentially of about 25% by weight beeswax, about 25% by weight palm kernel oil and the balance paraffin. The resulting WC-Co-wax mixture is heated to about 90° C. and held for about 20 minutes while being mixed. The mixture is then cooled to room temperature. The mixture is then attritor milled in water with about 45 kg of milling media for about 5 hours at about 200 rpm. The resulting attritor milled mixture is then spray dried to agglomerate it. The spray dried material is then pressed into green articles which are then sintered at about 1440° C.

While there has been shown and described what are at present considering the preferred embodiments of the invention, it will be obvious to those skilled in the art that various changes and modifications may be made therein without departing from the scope of the invention as defined by the appended claims.

What is claimed is:

1. A method for producing metal carbide grade powders, said method comprising:

(a) forming a wax mixture consisting essentially of in percent by weight about 10 to about 60 of an organic compound which is a solid at room temperature and said organic compound containing a C═O group, about 5 to about 50 oils, and the balance paraffin;

(b) heating said wax mixture to a temperature above the melting point of said mixture and maintaining said temperature;

(c) forming a powder-mixture consisting essentially of metal carbide powder, a binder metal selected from the group consisting of cobalt, nickel, and combinations thereof, and said wax mixture while heating said carbide powder, said binder metal and said wax mixture to a temperature above the melting point of said wax mixture and maintaining said temperature to result in a uniform distribution of said wax mixture on said carbide and binder metal particles;

(d) forming a slurry of the powder-wax mixture and water;

(e) attritor milling said slurry at a temperature below the melting point of said wax; and (f) removing the water from the resulting attritor milled powder-wax mixture and agglomerating said attritor milled powder-wax mixture to produce said metal carbide grade powder wherein a densified article made therefrom exhibits essentially no pores that are greater than about 10 micrometers in diameter after sintering at about 1350° C. to about 1540° C.

2. A method of claim 1 wherein said organic compound is selected from the group consisting of esters and organic acids.

3. A method of claim 2 wherein said organic compound is selected from the group consisting of beeswax, carnuba wax, lauric acid, myristic acid, palmitic acid, stearic acid, and combinations thereof.

4. A method of claim 1 wherein said oils are esterified oils.

5. A method of claim 1 wherein said oils make up about 5% to about 30% by weight of said wax mixture.

* * * * *